US006363918B2

(12) United States Patent
Håkansson et al.

(10) Patent No.: US 6,363,918 B2
(45) Date of Patent: Apr. 2, 2002

(54) PUMP ARRANGEMENT, FUEL DELIVERY SYSTEM AND LIQUID COOLING SYSTEM FOR AN INTERNAL COMBUSTION ENGINE INCORPORATING SUCH A PUMP AND A VEHICLE COMPRISING SUCH A FUEL DELIVERY SYSTEM AND LIQUID COOLING SYSTEM

(75) Inventors: Nils-Olof Håkansson, Stenkullen; Leif Larsson, Göteborg, both of (SE)

(73) Assignee: Volvo Lastvagnar AB (SE)

( * ) Notice: Subject to any disclaimer, the term of this patent is extended or adjusted under 35 U.S.C. 154(b) by 0 days.

(21) Appl. No.: 09/681,627

(22) Filed: May 11, 2001

Related U.S. Application Data

(63) Continuation of application No. PCT/SE99/02039, filed on Nov. 10, 1999.

(30) Foreign Application Priority Data

Nov. 12, 1998 (SE) ..... 9803895

(51) Int. Cl.[7] ..... F02M 37/04; F04B 49/00; F01P 5/10

(52) U.S. Cl. ..... 123/509; 123/41.44; 123/41.47; 123/198 C; 417/223

(58) Field of Search ..... 123/41.44, 41.47, 123/198 C, 509; 417/362, 223, 199.1, 201

(56) References Cited

U.S. PATENT DOCUMENTS

| | | | | | |
|---|---|---|---|---|---|
| 1,502,234 | A | | 7/1924 | Davis | |
| 2,625,106 | A | | 1/1953 | Hoffman | |
| 3,370,540 | A | | 2/1968 | Carpenter | |
| 4,925,367 | A | * | 5/1990 | Paliwoda et al. | 123/509 |
| 5,117,796 | A | * | 6/1992 | Tursky | 123/509 |
| 5,159,901 | A | | 11/1992 | Chonan | |
| 5,188,072 | A | * | 2/1993 | Nolte | 123/198 C |
| 5,340,284 | A | | 8/1994 | Nicol | |
| 5,704,331 | A | * | 1/1998 | Eberback et al. | 123/198 C |
| 5,779,456 | A | | 7/1998 | Bowes et al. | |
| 5,839,401 | A | * | 11/1998 | Gruber et al. | 123/198 C |
| 6,112,726 | A | * | 9/2000 | Saito et al. | 123/509 |
| 6,289,878 | B1 | * | 9/2001 | Blass | 123/509 |

* cited by examiner

*Primary Examiner*—Thomas N. Moulis
(74) *Attorney, Agent, or Firm*—Kilpatrick Stockton LLP

(57) ABSTRACT

A pump arrangement is disclosed having a housing, a first pumping chamber within the housing, a drive shaft carried by the housing, and first pumping means arranged for rotation within the first pumping chamber. The first pumping means is driven by the drive shaft. A second pumping chamber accommodating a second pumping means is separated from the first pumping chamber by the housing such that the housing forms common separation wall. To provide a compact arrangement in which the first and second pumping chambers are reliably sealed from each other, the second pumping means is driven by the drive shaft via a magnetic coupling. Thus, the coupling comprises a drive rotor connected to the drive shaft and a driven rotor carried by the housing. The driver rotor and the driven rotor are separated by a separation wall assembly serving as a static seal to hermetically seal the second pumping chamber from the drive shaft.

13 Claims, 7 Drawing Sheets

PUMP ARRANGEMENT, FUEL DELIVERY SYSTEM AND LIQUID COOLING SYSTEM FOR AN INTERNAL COMBUSTION ENGINE INCORPORATING SUCH A PUMP AND A VEHICLE COMPRISING SUCH A FUEL DELIVERY SYSTEM AND LIQUID COOLING SYSTEM

CROSS REFERENCE TO RELATED APPLICATIONS

This is a continuation patent application of International Application No. PCT/SE99/02039 filed Nov. 10, 1999 and which designates the United States; the disclosure of that application is expressly incorporated by reference in its entirety.

BACKGROUND OF INVENTION

1. Technical Field

The present invention relates to a pump arrangement primarily, though not exclusively, for use in vehicles. The invention further relates to a fuel delivery system incorporating such a pump arrangement. The invention also relates to a liquid cooling system for an internal combustion engine incorporating such a pump arrangement.

2. Background Information

In a commercial vehicle fuel delivery system it is known to use a rotary displacement pump driven by the transmission of the vehicle to increase the fuel pressure in the system to a level suitable for injection of the fuel into the vehicle engine. The pump has to be capable of delivering fuel at a sufficient pressure substantially immediately upon starting the engine. This implies that at high engine speeds the pressure in the fuel delivery system is greater than actually required. Consequently, an overpressure valve is required downstream of the pump to relieve the excess pressure.

A conventional rotary displacement pump comprises a housing, a pumping chamber within the housing, pressure increasing means in the form of intermeshing gears within the pumping chamber, and an input shaft to the housing for causing rotation of the intermeshing gears. To prevent leakage of the liquid pumped from the pumping chamber, an adequate sealing means is provided between the housing and the input shaft. Due to the rotation of the input shaft, a dynamic seal must be employed. In the fuel delivery system described above, failure of the sealing means not only implies that fuel leaks out of the system, but also that the leaking fuel may migrate into the transmission, mixing with the lubricant therein. Furthermore, the use of a transmission-driven fuel pump implies that a suitable location for the drive shaft to the pump has to be provided, as well as ensuring correct gearing for the drive shaft. Given the space constraints in modern vehicles, these demands are not always simple to accomplish.

It is also known to use an electrically driven pump for supplying fuel to an internal combustion engine. However, such a pump is not particularly efficient since electrical energy for driving the pump must be generated by the internal combustion engine and thereafter reconverted to mechanical energy in the pump, implying losses during conversion.

Virtually without exception, internal combustion engines used in commercial vehicles require liquid cooling using a coolant. The coolant is pumped through the engine by a water pump. Typically, the water pump is attached to the cylinder block and is driven by a belt from the crankshaft of the engine.

A dual pump system as described in U.S. Pat. No. 3,370,540 is comprised of a first gear pump having a drive member and a driven member, and a second gear pump magnetically driven by the first gear pump. The drive and driven members are made from magnetic material. The second gear pump has an internal gear element with magnetic material peripherally carried thereon juxtaposition to both the drive member and the driven member. The internal gear element is separated from the drive and driven members by an impermeable member attached to the pump body of the first gear pump. Rotation of the drive and driven members allows responsive rotation of the internal gear element. In this manner, two separate liquids may be pumped by the dual pump system. A disadvantage with this dual pump system is that two pump bodies are required, one for the first gear pump and one for the second gear pump.

Another dual pump arrangement is disclosed in DE-A-44 34 244. In that document, two axially arranged pumps are mechanically driven by a common drive shaft, with one pump acting as a fuel pump and the other serving as a power steering pump. A conceivable problem with this arrangement is the risk of leakage of liquid from one pump to the other due to failure of the seals around the common drive shaft.

SUMMARY OF INVENTION

It is an object of the present invention to provide a pump arrangement suitable for use in commercial vehicles for pumping fuel and coolant, wherein the pump arrangement is potentially more compact, energy efficient and easier to seal than previous arrangements.

This object is achieved in accordance with the present invention by a pump arrangement having a housing, a first pumping chamber within that housing, the first pumping chamber being adapted to be connected to a first liquid transport circuit, a drive shaft carried by the housing, a first pumping means arranged for rotation within said first pumping chamber, the first pumping means being driven by the drive shaft, a second pumping chamber separated from the first pumping chamber by the housing such that the housing forms a common separation wall, the second pumping chamber being adapted to be connected to a second liquid transport circuit, the second pumping chamber accommodating the second pumping means being driven by the drive shaft, wherein the second pumping means is driven by the drive shaft via a magnetic coupling, the coupling comprising a driver rotor connected to the drive shaft and a driven rotor carried by the housing, the driven rotor driving the second pumping means, the driver rotor and the driven rotor being separated by a separation wall assembly serving as a static seal to hermetically seal the second pumping chamber from the drive shaft.

Accordingly, the pump arrangement of the present invention is a single compact unit which is able to pump two separate liquids in respective liquid transport circuits with greatly reduced risk of inadvertent mixing of the two liquids. Furthermore, since the magnetic coupling is only capable of transmitting a predetermined value of torque, the pressure downstream of the pump cannot exceed a predetermined value, irrespective of the rotational speed and/or torque of the input shaft.

The invention further provides for a fuel delivery system incorporating the pump arrangement of the present invention, as well as a liquid cooling system incorporating said pump arrangement.

In addition, the invention provides for a vehicle comprising the fuel delivery system and the liquid cooling system of the present invention.

Further preferred embodiments of the invention are detailed in the dependent claims.

BRIEF DESCRIPTION OF DRAWINGS

The invention will be described in greater detail in the following by way of example only and with reference to embodiments shown in the attached drawings, in which.

DETAILED DESCRIPTION

Figure 1:
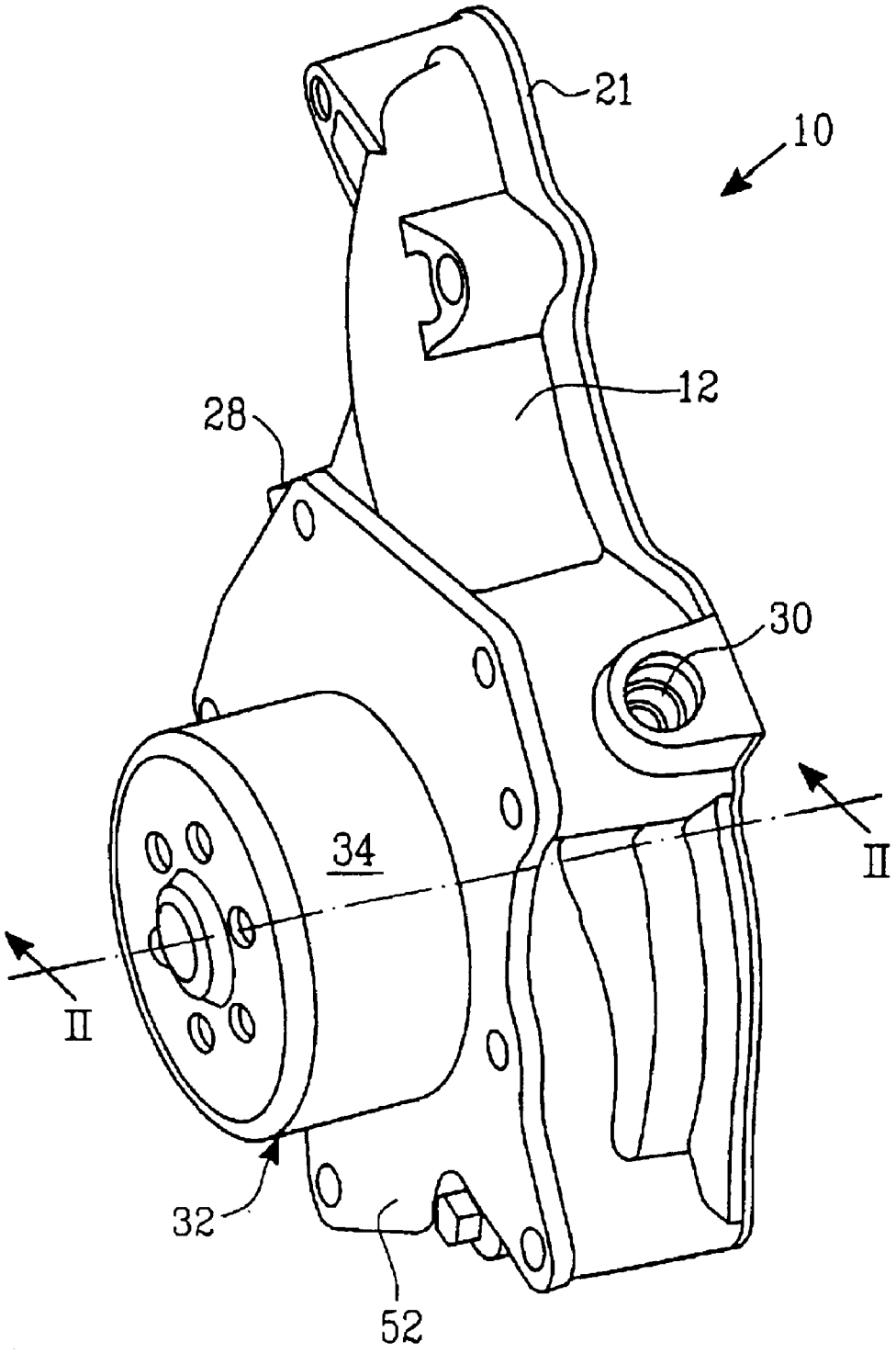
FIG. 1 is a schematic perspective view of the pump arrangement of the present invention.

Following, the pump arrangement of the present invention will be described in a preferred embodiment for use as a combined fuel pump and water pump for an internal combustion engine. It is to be understood, however, that such embodiment is described by way of example only, and that the pump arrangement may be employed for any application wherein its particular advantages may be utilized.

In the drawings, reference numeral 10 generally denotes a pump arrangement according to the present invention. The pump comprises a housing 12 that, in a preferred embodiment of the present invention, is bolted or attached in any suitable manner to the block of an internal combustion engine.

Figure 2:
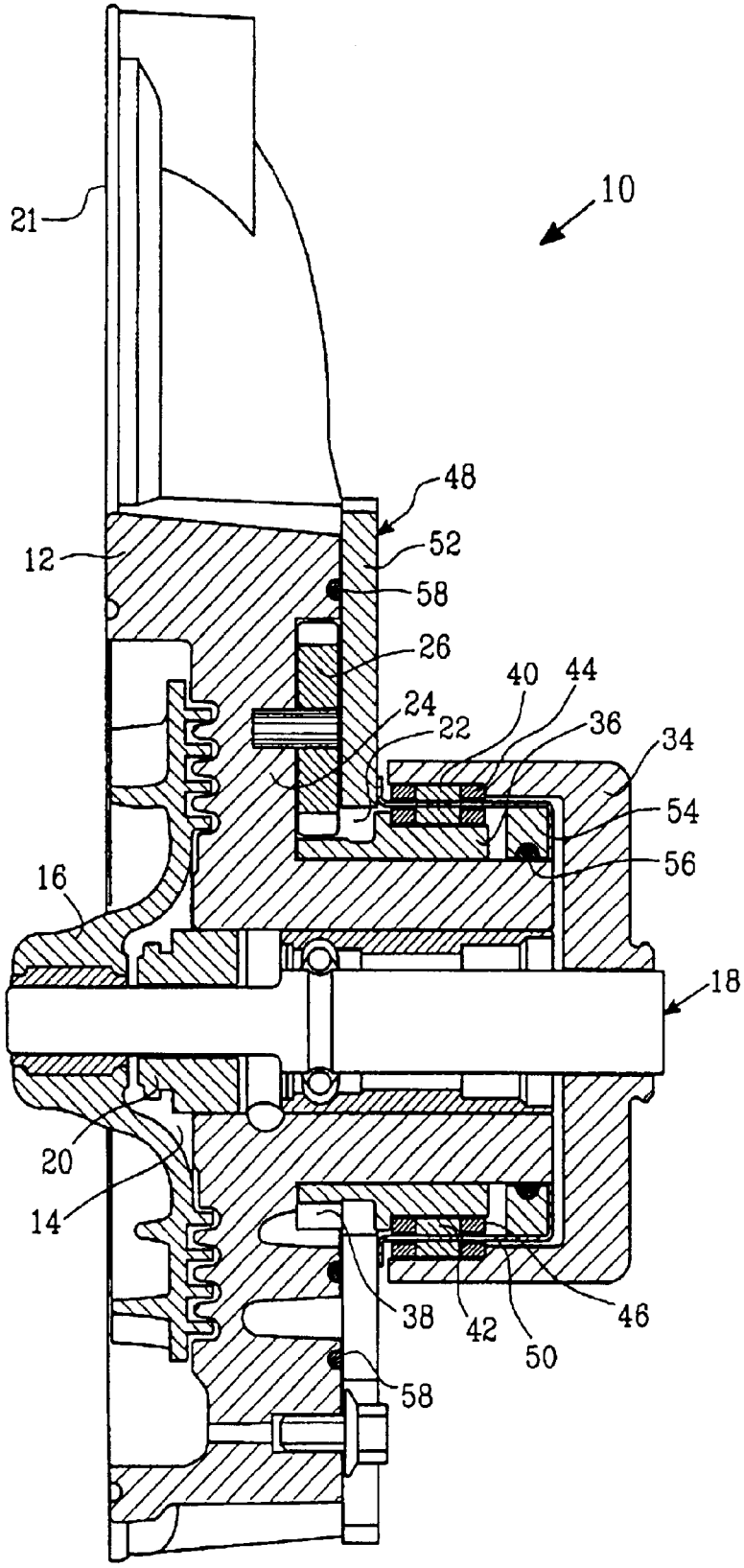
FIG. 2 is a schematic cross-sectional view along line II—II of FIG. 1.

With particular reference to FIG. 2, the pump arrangement 10 comprises a first pumping chamber 14 within the housing 12. The first pumping chamber is connectable to a first liquid transport circuit, for example, the liquid cooling system of a vehicle engine. Thus, in a known manner, the first pumping chamber 14 may be used to generate pressure in a liquid coolant. To this end, a first pumping means 16 in the form of an impeller is rotatable within the first pumping chamber. To effect rotation of the impeller 16, the impeller is connected to a drive shaft 18 carried by the housing 12. The drive shaft 18 rotates by a (not shown) drive belt or gear train driven by the crankshaft of the engine that the pump arrangement is attached to. A sealing bush 20 is provided between the drive shaft 18 and the housing 12, thereby preventing leakage of the liquid coolant out of the first pumping chamber past the drive shaft. Liquid coolant is introduced into the first pumping chamber 14 through an opening arranged concentrically with the drive shaft 18 and exits the first pumping chamber via an outlet 21, thereafter continuing its path through the first liquid transport circuit.

The pump arrangement 10 also incorporates a second pumping chamber 22 adapted to be connected to a second liquid transport circuit, with the second pumping chamber hermetically sealed from the first pumping chamber 14. In other words, the contents of the first pumping chamber cannot enter the second pumping chamber or vice versa. Accordingly, the first pumping chamber 14 may be formed in a first surface of the housing 12 and the second pumping chamber 22 formed in a second surface of the housing. In this manner, the housing serves as a common separation wall 24 between the pumping chambers. Although the housing 12 is shown in the drawings as a unitary piece, it is to be understood that the housing may also be fabricated from a plurality of components. Thus, the expression "common separation wall" is intended to encompass both a unitary wall and a fabricated wall.

Figure 3:
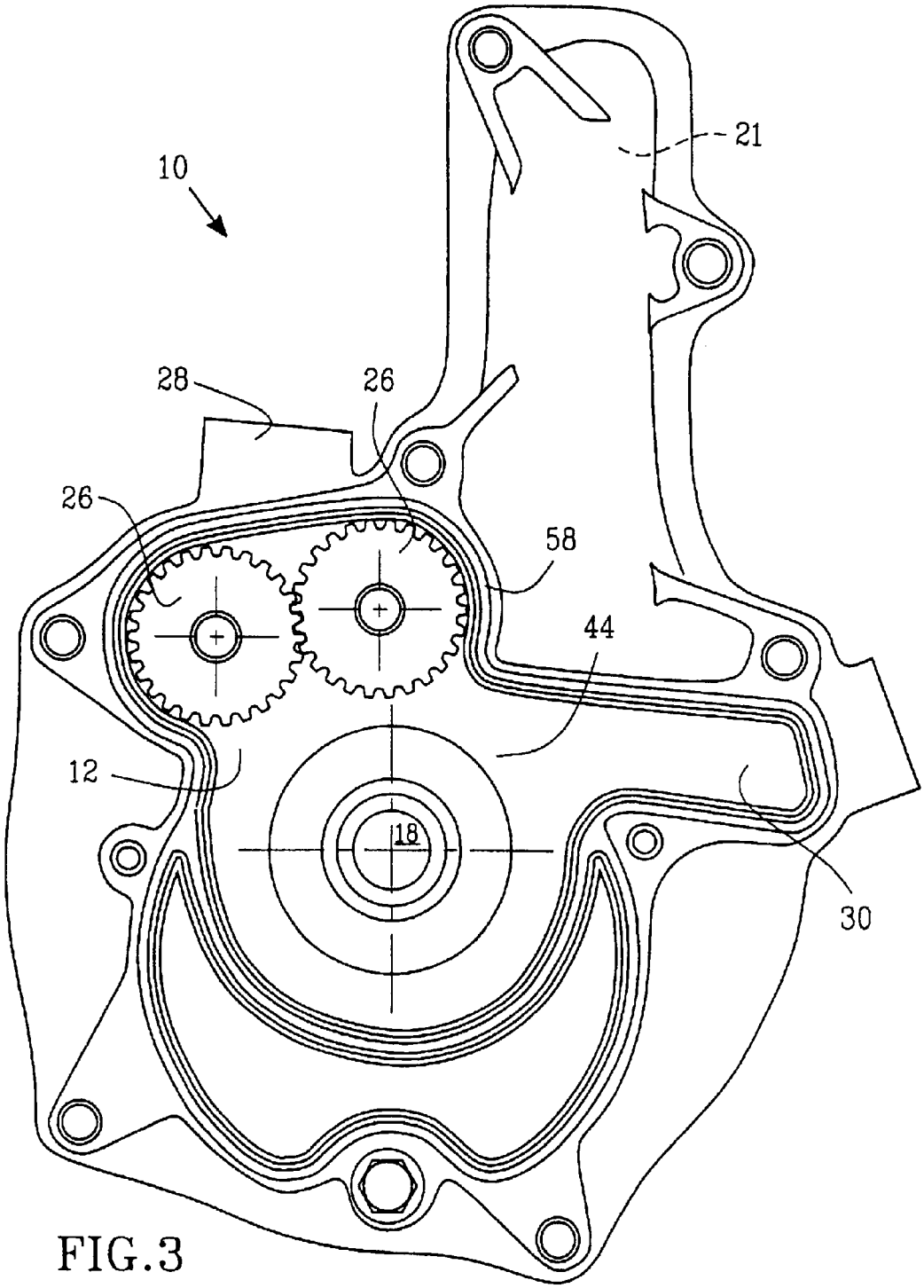
FIG. 3 is a simplified end view of the pump arrangement according to the present invention in a partially dismantled condition.

In the described embodiment, the second liquid transport circuit is a fuel delivery system and the second pumping chamber increases the pressure in fuel. To achieve this, the second pumping chamber 22 accommodates a second pumping means 26 in the form of, for example, a pair of intermeshing gear wheels (see FIG. 3). The second pumping chamber 22 has an inlet 28 and an outlet 30 for the liquid to be pumped, i.e., fuel in the exemplary embodiment. In a manner which will be explained in more detail herein below, and in accordance with the present invention, the second pumping means 26 is driven by the drive shaft 18 via a magnetic coupling 32.

As is most clearly apparent from FIG. 2, the coupling 32 comprises a driver rotor 34 connected to the drive shaft 18, for example, by splines or a keyed connection, and a driven rotor 36 carried by the housing 12. The driver rotor 34 and the driven rotor 36 are concentrically arranged about the drive shaft 18. The driven rotor 36 is journaled for rotation on the housing and drives the second pumping means 26 via a toothed peripheral section 38 on the driven rotor. In a preferred embodiment of the invention, the driver rotor 34 supports a number of first magnets 40 arranged circumferentially on the driver rotor 34 and the driven rotor 36 supports a number of second magnets 42 arranged circumferentially on the driven rotor. The first magnets 40 on the driver rotor are held in a first magnet holder assembly 44 and the second magnets 42 on the driven rotor 36 are held in like manner in a second magnet holder assembly 46. The first and second magnet holder assemblies 44, 46 are each preferably in the form of an annular ring having a number of recesses equal to the number of magnets for maintaining the magnets in spaced peripheral relationship. To ensure optimal torque transmission through the coupling 32, the first and second magnet holder assemblies 44, 46 should be substantially radially aligned.

Figure 5:
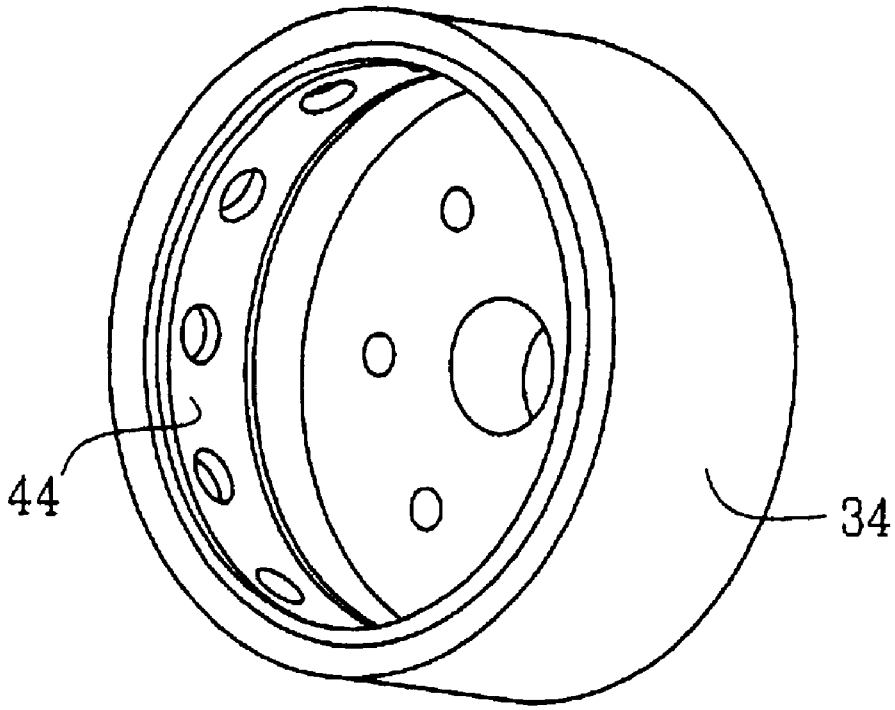
FIG. 5 is a schematic perspective view of the driver rotor forming a part of the pump arrangement according to the present invention.

In the preferred embodiment shown in the drawings, the first magnet holder assembly 44 is arranged on a radially inwardly facing surface of the driver rotor 34 (see also FIG. 5), and the second magnet holder assembly 46 is arranged on a radially outwardly facing surface of the driven rotor 36. A construction is, however, conceivable in which the relative positions of the first and second magnet holder assemblies 44, 46 are reversed.

Figure 4:
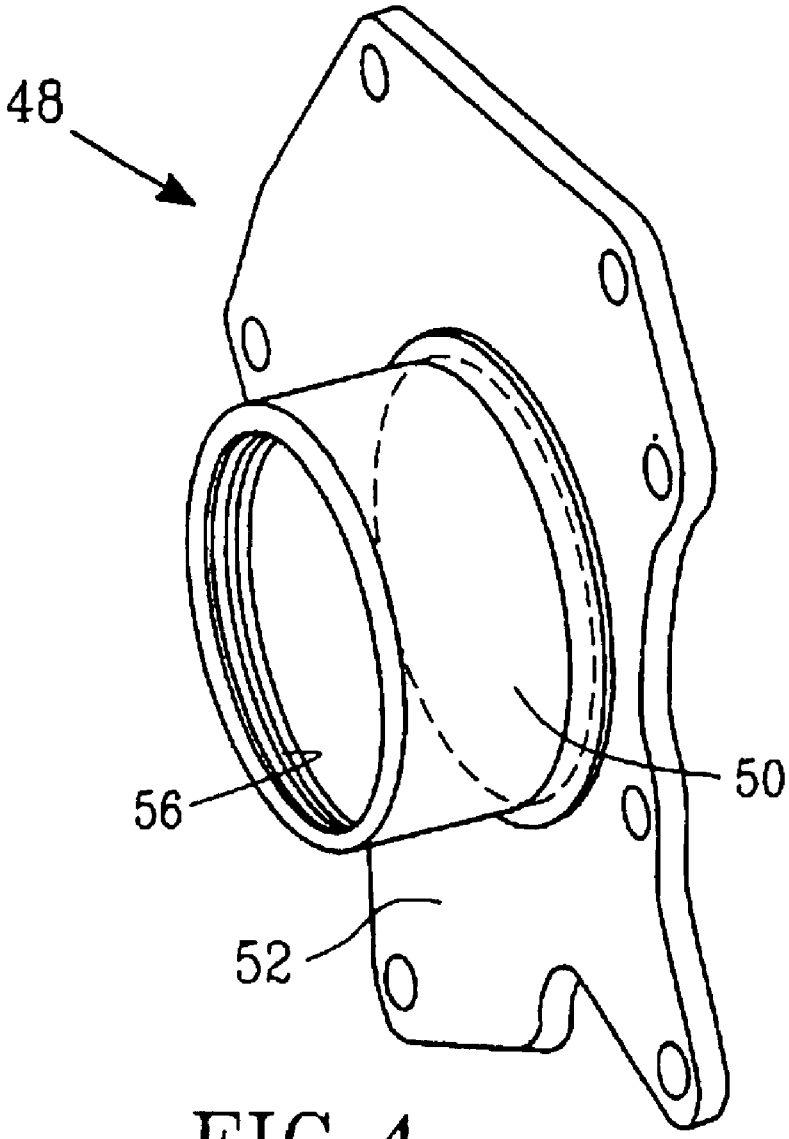
FIG. 4 is a schematic perspective view of the separation wall assembly forming a part of the pump arrangement of the present invention.

To ensure that the second pumping chamber 22 is sealed, a separation wall assembly generally denoted by reference numeral 48 is provided. With particular reference to FIGS. 2 and 4, the separation wall assembly 48 serves to separate the driver rotor 34 and the driven rotor 36. More particularly, the separation wall assembly 48 has an annular portion 50 arranged substantially parallel to the drive shaft 18, the annular portion 50 passing through a gap between the first and second magnet holder assemblies 44, 46. At a first axial end of the annular portion 50, the separation wall assembly 48 has a radially outwardly extending flange 52 partially delimiting the second pumping chamber 22. At a second axial end of the annular portion 50, the assembly 48 has a radially inwardly extending flange 54 comprising sealing means 56 for sealing against the housing 12. The radially outwardly extending flange 52 may also be provided with a sealing means 58 to assist in retaining liquid within the second pumping chamber 22. It will thus be apparent that the separation wall assembly 48 serves as a static seal to hermetically seal the second pumping chamber 22 from the rotating drive shaft 18 and driver rotor 34.

In terms of material selection, the separation wall assembly 48 may be made from steel, preferably stainless steel, while the housing 12 and the first and second magnet holder assemblies 44, 46may be made from aluminum.

The amount of torque which can be transmitted through the coupling 32 depends on the strength of the magnets and the size of the gap between the first and second magnet holder assemblies 44, 46. The parameters determining the amount of torque which can be transmitted can of course be selected for each chosen application. A major advantage of using a magnetic coupling is that when a certain value of torque is applied across the coupling 32, the second magnet holder assembly 46 tends to lag behind the first magnet holder assembly 44, i.e., the coupling "slips". Should the amount of torque increase further, the first magnet holder assembly 44 "skips" relative to the second magnet holder assembly 46 and proceeds to rotate faster than the second magnet holder assembly 46 while still transmitting the same maximum amount of torque. Accordingly, the preferred coupling 32 of the present invention is eminently suitable for use in applications in which a maximum amount of torque transmission is desired irrespective of the applied torque.

Operation of the pump arrangement 10 of the present invention will be described in the following in which the pump arrangement 10 is used to pump both a coolant and a fuel for an internal combustion engine.

When the drive shaft 18 rotates, coolant is drawn into the first pumping chamber 14 due to rotation of the impeller 16. After being subjected to an increase in pressure, the coolant exits the first pumping chamber via the outlet 21. Should the impeller 16 be directly attached to the drive shaft 18, the volume flow rate of coolant will be substantially proportional to the rotational speed of the drive shaft 18.

Rotation of the drive shaft 18 also effects rotation of the driver rotor 34 and, hence, the first magnet holder assembly 44. The magnetic field between the magnets of the first and second magnet holder assemblies 44, 46 causes the second magnet holder assembly 46 and thus the driven rotor 36 to rotate. As a result, the toothed peripheral section 38 of the driven rotor 36 engages with the gear wheels 26 of the second pumping means 26 within the second pumping chamber 22, drawing fuel into the chamber 22 via the inlet 28. After being subjected to an increase in pressure, the fuel exits the second pumping chamber via the outlet 30, continuing its path through the second liquid transport circuit.

For internal combustion engines equipped with a fuel injection system, the pump arrangement 10 has to be capable of delivering fuel at a sufficient pressure substantially immediately upon starting the engine. Accordingly, the pump arrangement 10 is designed such that fuel exits the second pumping chamber 22 at sufficiently high pressure, even at low rotational speeds of the drive shaft 18. To prevent excess pressure arising in the fuel system at higher rotational speeds of the drive shaft, the coupling 34 is arranged to slip in the manner described above if the applied torque is greater than that necessary to maintain the desired pressure in the fuel system. In this manner, it is ensured that the pumping pressure in the second pumping chamber 22 never exceeds a desired level.

Figure 6:
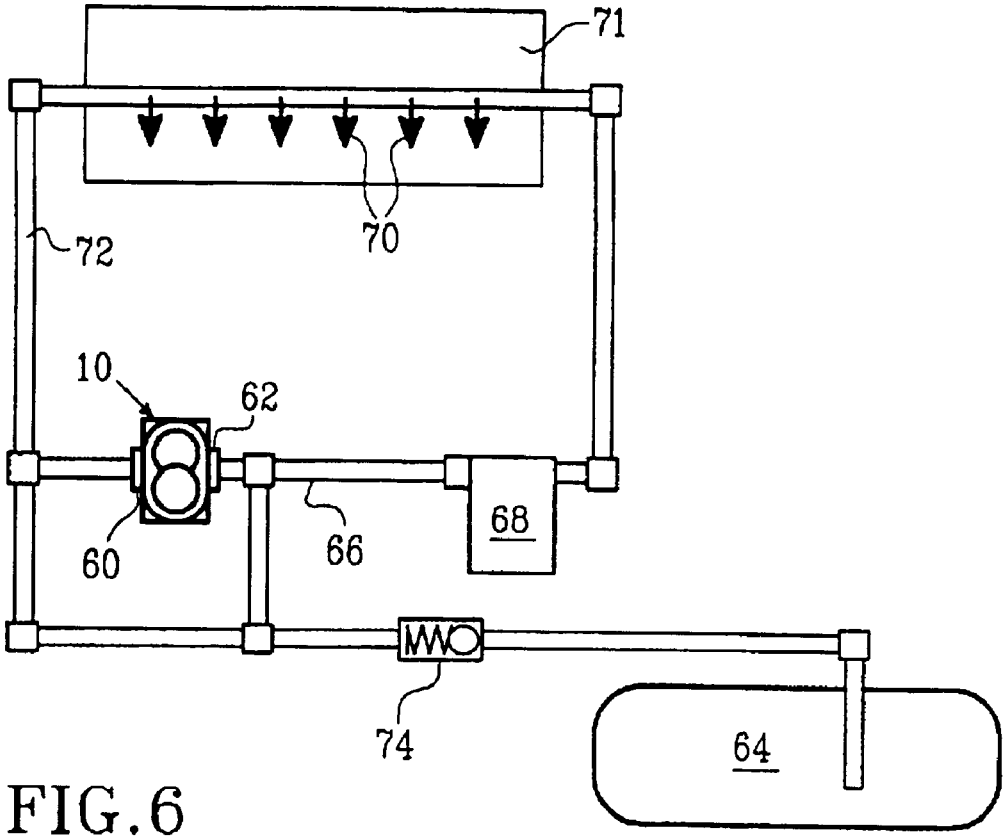
FIG. 6 is a schematic representation of a fuel delivery system incorporating the pump arrangement according to the present invention.

The above-described pump arrangement 10 is eminently suitable for use as a fuel pump in a vehicle fuel delivery system. Such a system is schematically illustrated in FIG. 6 and serves as the second liquid transport circuit. In FIG. 6, the pump is denoted by reference numeral 10. The pump 10 has a suction side 60 and an output side 62. The suction side 60 of the pump 10 is connected to a fuel reservoir 64. A fuel delivery line 66 is connected to the output side 62 of the pump 10. A fuel filter 68 is connected to the delivery line 66. Downstream of the fuel filter 68, a number of fuel injectors 70 are provided with fuel via the delivery line 66. The fuel injectors 70 are arranged to inject fuel into cylinders of an internal combustion engine 71. In order to ensure that the fuel delivered to the injectors 70 has a substantially uniform temperature, the pump 10 is arranged to pump a greater quantity of fuel along the delivery line 66 than is required by the injectors. The fuel surplus is returned to the suction side 60 of the pump via a return line 72. A further advantage of this arrangement is that fuel is recirculated through the filter 68 a number of times, thereby increasing the purity of the fuel.

In a typical installation, the pump 10 can be arranged to pump between 2 and 8 liters/minute (l/min) of fuel at a maximum pressure of about 9 bar in the fuel delivery line 66 adjacent the outlet side 62 of the pump 10. Normally, a maximum pressure of about 6 bar is sufficient in the fuel delivery line 66. Thus, an (not shown) overpressure valve may be incorporated in the fuel delivery system. Depending on the load on the engine 71, between about 0.5 and 1.5 l/min of fuel is injected into the engine 71 via the injectors 70. This implies that between about 1.5 and 7.5 l/min of fuel is returned to the pump 10. An amount of fuel corresponding to that which has been injected into the engine 71 is drawn from the reservoir 64 by the pump 10. A one-way valve 74 between the reservoir 64 and the pump 10 ensures that fuel in the return line 72 does not drain into the reservoir 64.

Since the magnetic coupling in the pump 10 can be adapted to ensure that a maximum pressure of no more than 9 bar is generated in the delivery line 66, even if the overpressure valve should stick shut, no damage will result. This further implies that less power is needed to drive the pump 10 than with conventional pumps in which the fuel output pressure is much greater than 9 bar at higher pump speeds.

Figure 7:
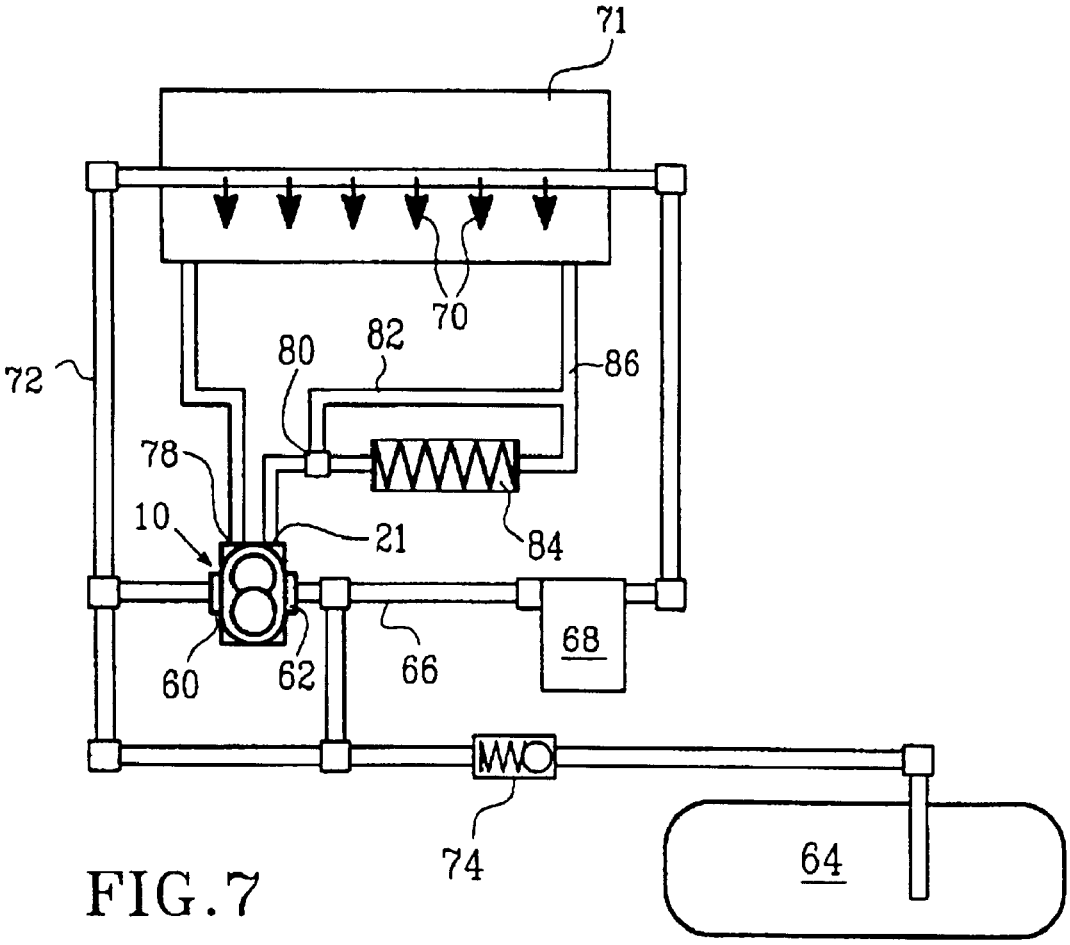
FIG. 7 is a schematic representation corresponding to FIG. 6, further illustrating a liquid cooling system incorporating the pump arrangement according to the present invention.

The system shown schematically in FIG. 7 corresponds essentially to FIG. 6, though with the addition of a liquid cooling system, connected to the pump arrangement 10. Accordingly, the liquid cooling system serves as the first liquid transport circuit. Coolant from the engine 71 passes into an inlet 78 of the pump arrangement 10 and exits the arrangement via the outlet 21. Downstream of the pump arrangement there is located a thermostat 80 for diverting flow either along a bypass conduit 82 or through a heat exchanger 84. After flowing through either the bypass conduit 82 or heat exchanger 84, the coolant returns to the engine 71 via a return conduit 86.

It is to be understood that the invention is not restricted to the embodiments described above and shown in the drawings, but may be varied within the scope of the appended claims. For example, although the pump arrangement has been described in an application in which two different liquids are pumped, it is to be understood that the liquids of the first and second liquid transport circuits may be of the same type. What is important is that the liquids of the two circuits are maintained in their respective circuits at least through the pump arrangement without any mixing of the liquids taking place.

What is claimed is:

1. A pump arrangement comprising:

a housing;

a first pumping chamber within said housing, said first pumping chamber connectable to a first liquid transport circuit;

a drive shaft carried by said housing;

a first pumping means arranged for rotation within said first pumping chamber, said first pumping means being driven by said drive shaft;

a second pumping chamber separated from said first pumping chamber by said housing such that said housing forms a common separation wall, said second pumping chamber connectable to a second liquid transport circuit, said second pumping chamber accommodating second pumping means being driven by said drive shaft;

wherein said second pumping means is driven by said drive shaft via a magnetic coupling, said coupling comprising a driver rotor connected to said drive shaft and a driven rotor carried by said housing, said driven rotor driving said second pumping means, said driver rotor and said driven rotor being separated by a separation wall assembly serving as a static seal to hermetically seal the second pumping chamber from said drive shaft.

2. The pump arrangement as claimed in claim 1, wherein said driver rotor supports a number of first magnets arranged circumferentially on said driver rotor, and in that said driven rotor supports a number of second magnets arranged circumferentially on said driven rotor.

3. The pump arrangement as claimed in claim 2, wherein said number of first magnets on said driver rotor are held in a first magnet holder assembly, in that said number of second magnets on said driven rotor are held in a second magnet holder assembly, and in that said first and second magnet holder assemblies are substantially radially aligned.

4. The pump arrangement as claimed in claim 3, wherein said first magnet holder assembly is arranged on a radially inwardly facing surface of said driver rotor, and said second magnet holder assembly is arranged on a radially outwardly facing surface of said driven rotor.

5. The pump arrangement as claimed in claim 1, wherein said separation wall assembly has an annular portion arranged substantially parallel to said drive shaft, said annular portion passing through a gap between said first and second magnet holder assemblies, in that at a first axial end of said annular portion, said separation wall assembly has a radially outwardly extending flange partially delimiting said second pumping chamber, and in that at a second axial end of said annular portion, said assembly has a radially inwardly extending flange comprising sealing means for sealing against said housing.

6. The pump arrangement as claimed in claim 5, wherein said separation wall assembly is made from steel.

7. The pump arrangement as claimed in claim 3, wherein said housing and said first and second magnet holder assemblies are made from aluminum.

8. A fuel delivery system comprising the pump arrangement as claimed in claim 1.

9. The fuel delivery system as claimed in claim 8, said system further comprising a fuel reservoir connected to a suction side of said pump arrangement, a fuel delivery line connected to an output side of said pump arrangement, a fuel filter in said delivery line, a number of fuel injectors connected to said delivery line downstream of said fuel filter, and a return line from said number of injectors to said suction side of said pump arrangement.

10. The fuel delivery system of claim 9, wherein said magnetic coupling in said pump arrangement restricts the amount of torque transmitted to the driven rotor such that a maximum pressure of about 9 bar is attained at said output side of said pump.

11. A liquid cooling system comprising the pump arrangement as claimed in claim 1.

12. A vehicle comprising the fuel delivery system as claimed in claim 8.

13. A vehicle comprising the liquid cooling system as claimed in claim 11.

* * * * *